United States Patent [19]

Ehrmann et al.

[11] 4,332,406

[45] Jun. 1, 1982

[54] LOCK CATCH FOR DOORS

[75] Inventors: Wolfgang Ehrmann, Ruppichteroth; Claus Winter, Hamburg, both of Fed. Rep. of Germany

[73] Assignee: Firma Hafele KG, Ruppichteroth, Fed. Rep. of Germany

[21] Appl. No.: 83,857

[22] Filed: Oct. 11, 1979

[30] Foreign Application Priority Data

Oct. 17, 1978 [DE] Fed. Rep. of Germany ..... 2845110

[51] Int. Cl.[3] ..... E05C 3/12

[52] U.S. Cl. ..... 292/18

[58] Field of Search ..... 292/18, 14, 44, 78, 292/79, DIG. 21

[56] References Cited

U.S. PATENT DOCUMENTS

| | | | |
|---|---|---|---|
| 1,013,553 | 1/1912 | Johnson | 292/DIG. 21 |
| 1,016,422 | 2/1912 | Laurilsen | 292/121 |
| 1,137,863 | 5/1915 | Keough | 292/18 |
| 1,756,718 | 4/1930 | Wild | 292/DIG. 21 |
| 2,828,150 | 3/1958 | Weaver | 292/78 |

FOREIGN PATENT DOCUMENTS

| | | | |
|---|---|---|---|
| 51257 | 10/1941 | Netherlands | 292/18 |

*Primary Examiner*—Richard E. Moore

[57] ABSTRACT

A lock catch for doors having holding elements thereon includes a catch housing formed with at least one door-mounted holding element-receiving slot therein. At least one locking lever is pivotably mounted within the catch housing. A spring is positioned within the catch housing to normally bias the locking lever to project into the slot. A first bevelled surface is formed on the locking lever and is engageable by the holding element on the door when the door is closed, such engagement resulting in pivotal movement of the locking lever in a first direction to permit entrance of the holding element into an inner end region of the slot inwardly of the locking lever. A second bevelled surface is formed on the locking lever is engageable by the holding element of the door upon withdrawal of such element from the inner end region of the slot in which it has been locked releasably. Such engagement effects pivotal movement of the locking lever in a second and different direction to permit withdrawal of the holding element from the slot. The spring is so positioned relative to the pivot axis of the locking lever and the bevelled surfaces thereof that the effective lever arm of the locking lever when the first bevelled surface is engaged by the holding element entering the slot is greater than the effective lever arm of the spring acting on the locking lever. Further, the effective lever arm of the spring acting on the locking lever is greater than the effective lever arm of the locking lever when the second bevelled surface is engaged by the holding element during withdrawal of the holding element from the inner end region of the slot.

12 Claims, 8 Drawing Figures

LOCK CATCH FOR DOORS

BACKGROUND OF THE INVENTION

The invention relates to a lock catch for double doors in which door-mounted holding elements are cooperable with lock catch locking elements and wherein a spring within the catch housing biases the locking elements into their closing position, the holding element of one door being blocked in its closing position when the holding element of the other door is also brought into its closing position. With a lock catch as described, both doors can be closed only in a certain sequence and can be opened again only in the reverse sequence.

Britsh Pat. No. 1,254,392 discloses a lock catch of the above mentioned kind which ensures the closing function. In this known lock catch the two locking elements are formed as slides which maintain within the catch housing in the closing positions by means of a compression spring. The catch housing is fastened to the frame of the doors so that the displacement direction of the slides is parallel to the open front of the door frame. The slides protrude from the catch housing by a triangular ratchet tip. On the doors, holding elements are fastened which have a triangular detent. When one door is closed, its holding element displaces the corresponding slide counter to the force of the spring, until the slide engages with the detent of the holding element in the closed position of the door. To block the door which is closed first, another slide is displaceably guided in the catch housing, this slide being displaced by the holding element of the second door. When the second door is brought into the closing position, the displaced second slide prevents a displacement of the slide associated with the first door, which slide thus blocks the holding element of the first door. Therefore, the first door can be opened only after the last-closed door has been opened and when the holding element on the first door releases its associated slide.

This known lock catch, however, has the disadvantage that the closed doors do not closely abut the front edges of the door frame. As the slide and holding elements have a ratchet position defined in the closing direction, tolerances of the door, of the frame and in the attachment of the catch housing and of the holding elements cannot be compensated.

To overcome the shortcomings noted above, attempts have been made to design the holding elements as inclined ratchet elements engageable over the triangular ratchet tips from behind. In this way, a part of the spring force acting on the slides is transformed into an attractive force component which pulls the closed door against the frame for the door. Since the ratchet flaps can only be very short, the holding elements and the catch housing must be mounted on the doors and on the door frame very precisely. Since the slides are pushed against the ratchet flaps with great force and acts on a large area, the preponderant part of the attractive force component is thereby cancelled out.

It is an object of the invention to provide a lock catch of the above mentioned kind which is of relatively simple construction, can easily be fastened to the door frame and the doors, and yet chieves positive locking action, compensation of the parts and attachment tolerances and maintains blocking of the door which is closed first.

SUMMARY OF THE INVENTION

According to the invention, the holding elements are formed as holding bolts which can be introduced into receiving slots in the catch housing; the locking elements are formed as locking levers pivotably mounted in the catch housing and extendable into a receiving slot for each; the locking levers, as the holding bolts are introduced into the associated receiving slots, are deflected therefrom; the introducted holding bolts are then held in the end regions of the receiving slots by the spring action of the locking levers which are pivoted back; and one locking lever so protrudes by a blocking shoulder into the end region of the receiving slot associated with the other locking lever that such one locking lever is nonpivotably retained by the holding bolt introduced into this receiving slot. With this design of the locking elements no separate locking slide need be provided, and the spring force acting on the locking levers is fully transmitted, after the deflection and return pivoting of the locking levers upon introduction of the holding bolts, to the latter and hence to the closed door, which thus is pulled up snugly against the door frame.

The pivoting of the locking levers which normally protrude into the receiving slots of the catch housing is achieved in a simple manner by the holding bolts being oriented with their edian axes perpendicular to the longitudinal axes of the receiving slots, the receiving slots being oriented horizontally and the holding bolts vertically. Further, the locking levers are rotatably mounted between the receiving slots on a common journal of the catch housing which is directed away from the introduction side of the receiving slots, the pivot axis being oriented perpendicular to the longitudinal axes of the receiving slots. Thereby enough space is created on the introduction side between the receiving slots to permit the required pivotal movement of the locking levers.

To create predetermined starting positions for the locking levers when the holding bolts are initially introduced into the receiving slots, it is further provided that the locking levers are held by means of the spring at stops of the catch housing which is arranged outside the path of the receiving slots.

A continuous deflection process for the locking levers during introduction and withdrawal of the holding bolts into and out of the receiving slots is achieved by providing the locking levers, toward the introduction side of the receiving slots, with deflection bevelled surfaces over which the holding bolt rides as it is being introduced, the locking lever being caused to pivot in the direction toward the other locking lever. The locking levers are provided, toward the inner end regions of the receiving slots, with pull-up (tightening) bevelled surfaces which form with the inner end regions of the receiving slots locking seats for the holding bolts which are retained in these locking seats under spring action. The pull-up bevelled surfaces are inclined so that also when the holding bolt is withdrawn, the associated locking lever is pivotable in the direction of the other locking lever.

In order that the locking levers can be used for a lock catch disposed at the bottom or top edges of the doors, the locking levers are laid out symmetrically with respect to a median plane perpendicular to the pivot axis so that they can, therefore, be rotatably mounted on the journal of the catch housing in two positions 180 degrees apart. Merely by the mounting of the locking levers as described above, therefore, the blocking can be shifted to one or the other receiving slot, as is necessary for double doors which are locked in the region of the lower edges and upper edges of the doors by means of separate lock catches.

The pivotable mounting of the locking levers is effected according to one embodiment in that one locking lever is mounted pivotably on the journal by means of two spaced bearing straps, while the other plate-shaped locking lever is rotatably mounted on the journal of the catch housing between these two straps.

The support of the spring for the two locking levers according to one embodiment includes a blind bore which is open toward the other locking lever and receives a helical spring.

In order that relatively large tolerances in the attachment of the doors or in applying the holding elements on the doors can be compensated for, it is further provided that the width of the receiving slots be greater than the diameter of the holding bolts.

The catch housing is preferably designed so that the housing consists of a box type bottom portion having a side wall provided on one side thereof with recesses, and a box type top portion having a side wall provided with the receiving slots on one side and on a cover plate, the receiving slots in the top portion being in general alignment with the recesses in the bottom portion.

For the simple attachment of the lock catch on the door frame, there is integrally formed on the bottom portion of the catch housing extending away from the introduction side of the housing, a fastening strap which in its opposed parallel edges is provided with open recesses or slots laid out to correspond with a given hole spacing on the door frame.

In order that minimum force is needed for locking of the doors with the holding bolts, while maintaining a strong closing force for the locked door, the deflection bevelled surfaces of the locking levers subtend an acute angle in the closing direction to the longitudinal medium axis of the receiving slots, whereas the pull-up bevelled surfaces subtend an obtuse angle in the opening direction.

The acute angle of the deflection bevelled surfaces provide when a holding bolt is being introduced, a greater lever arm relative to the fulcrum of the locking lever than that exerted by the compression spring which maintains the locking lever in its starting position. For this reason, the locking lever, when introducing the holding bolt, can be pivoted with little force. To this end the force of the return springs in the hinges of the hung door may be sufficient so that the door is brought into the locking position practically by itself.

The obtuse angle of the pull-up bevelled surfaces serves primarily for the purpose that the full force of the compression spring pulls the locked door against the door frame. The lever arm acting on the holding bolt in this instance is smaller than the lever arm of the compression spring, so that a biasing force is developed. To open the locked door, therefore, this biasing force must be overcome. In addition, the closing forces of the return springs in the hinges must be overcome.

It can thus be seen that by this design of the deflection and pull-up bevelled surfaces of the locking levers a closing-opening characteristic greatly different from the known lock catches is achieved. Closing of the doors occurs easily, i.e. practically automatically once brought by means of the holding bolts into the region of the lock catch particularly if the hinges are provided with return springs, while greater tractive forces are required to open the doors.

BRIEF DESCRIPTION OF THE DRAWINGS

The invention will be explained in greater detail with reference to an embodiment illustrated in the drawings, in which.

DESCRIPTION OF PREFERRED EMBODIMENTS

Figure 1:
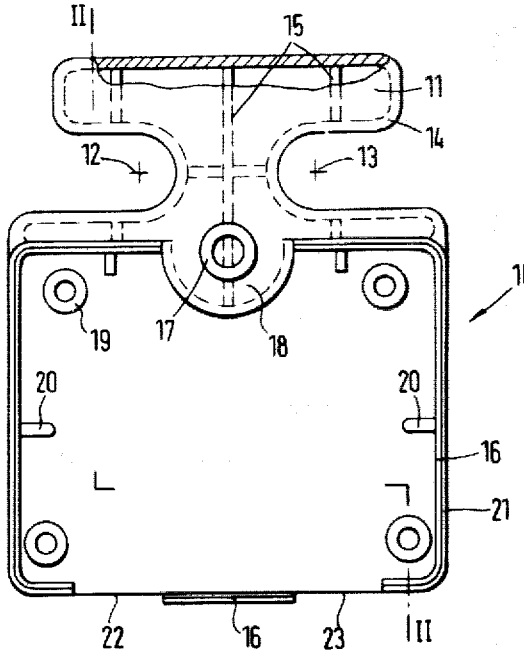
FIG. 1, is a plan view into the box type bottom portion of the catch housing.
Figure 2:
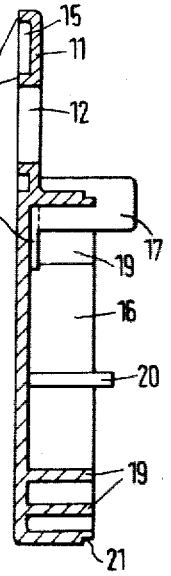
FIG. 2, is a side elevational view, partly in cross-section, of the bottom portion of the catch housing taken along line II—II of FIG. 1.
Figure 3:
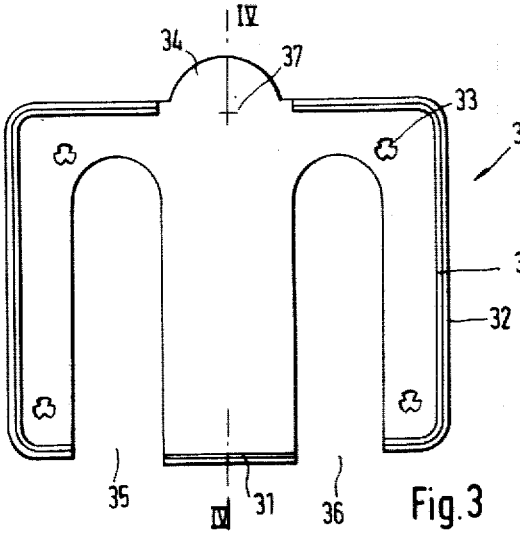
FIG. 3, is a plan view into the box type top portion of the catch housing showing the holding bolt receiving slots.
Figure 4:
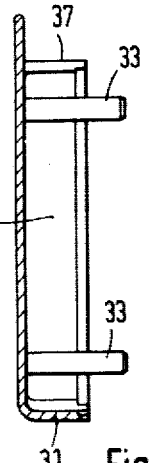
FIG. 4, is a side elevational view, partly in cross-section, of the upper portion of the catch housing taken along lines IV—IV of FIG. 3.

The lock catch according to the invention is contained in a catch housing which is composed of a bottom portion 10 shown in FIGS. 1 and 2 and a top portion 30 shown in FIGS. 3 and 4.

The bottom portion 10 is a box type design, one end of the side wall 16 having recesses 22 and 23 which are in alignment with receiving slots 35 and 36 in the cover plate and side wall 31 of the box type top portion 30 when the two portions are joined together. The joining of bottom portion 10 and top portion 30 can be effected via connecting sleeves 19 integrally formed on the bottom portion 10 and connecting pins 33 integrally formed on the top portion 30. The connecting pins are dimensional and configured to be wedged or otherwise held in the connecting sleeves 19. The bottom portion 10 and top portion 30 are preferably made as metal die-cast parts.

The edges of the side walls 16 and 31 of bottom portion 10 and top portion 30 are provided with staggered connecting bridges 21 and 32, so that the overlapping connection between bottom portion 10 and top portion 30 of the catch housing effects a tight closing of the top and bottom portions.

In the assembled state, the bottom portion 10 and top portion 30 form two interior and parallel seats for the door holding elements which are designed as holding pins. These seats are formed by the recesses 22 and 23 in the bottom portion 10 and the receiving slots 35 and 36 in the top portion 30 and which open toward one end of the catch housing as can be seen from FIG. 6. This end is termed the introduction end. The end of the side wall 16 opposite the introduction end has a central recess formed therein in which the bottom plate of the bottom portion 10 is stepped upwardly and carries a journal 17. A raised shoulder 18 of the bottom plate serves as a bearing for the locking levers to be mounted to the catch housing, as will be shown later. The raised shoulder 18 extends outside the side wall 16 to form an attachment strap or plate 11. The rectangularly bent edges 14 and the integrally formed stiffening ribs or bridges 15 provide the fastening flange 11 with increased strength. In the parallel edges of the attachment plate 11, there are formed fastening slots 12 and 13 which are open to the outside and are matched to a given hole spacing. The catch housing can therefore be secured on the door frame by means of the bottom plate of the bottom portion 10 utilizing selected holes of a series of holes formed in the door frame.

On the end opposite to the introduction end, the upper portion 30 also is given a recess 37 in the side wall 31. The cover plate of the top portion 30 is extended outwardly in semicircular form, as reference numeral 34 shows. This semicircular portion of the cover plate completes the abutment for the locking levers.

Figure 5:
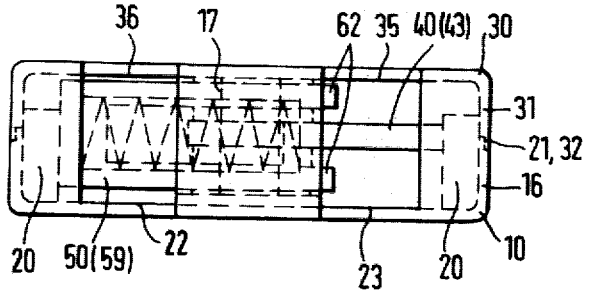
FIG. 5, is a front view in the direction of the introduction side of the assembled lock catch.
Figure 6:
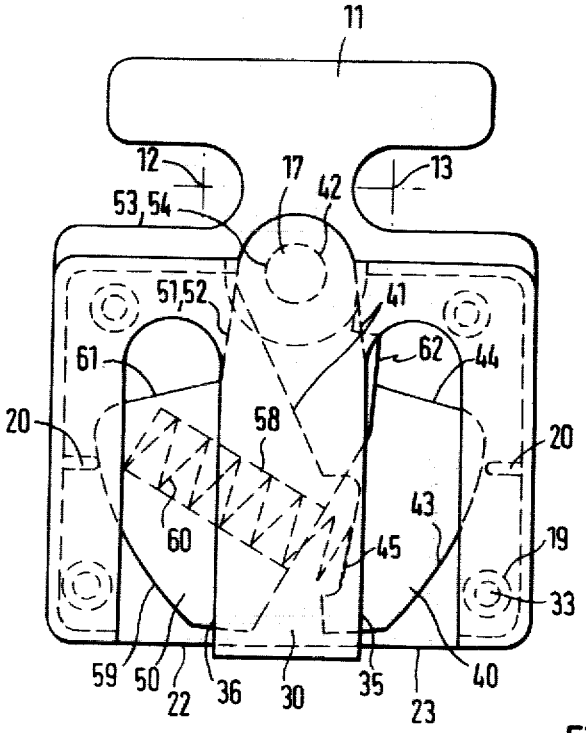
FIG. 6, is a top view of the assembled lock catch.

Projecting inwardly from the mutually opposite inner sides of the side wall 16, stops 20 are integrally formed which limit the outward pivotal movement of the locking levers 40 which are mounted pivotably about the journal 17 and which, thereby, fix starting positions thereof, as FIGS. 5 and 6 show.

Figure 7:
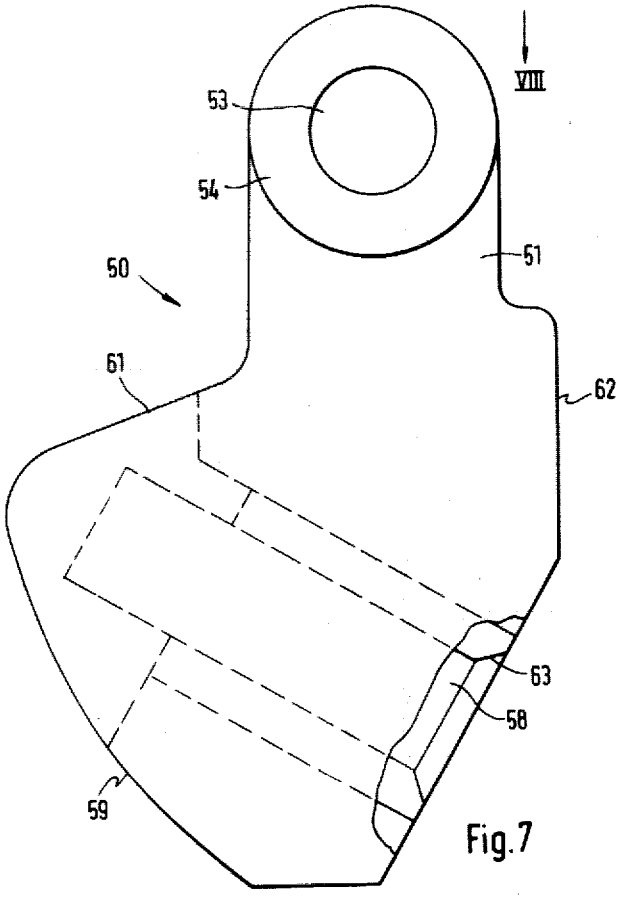
FIG. 7, is an enlarged plan view showing the locking lever with the blind bore for the spring.
Figure 8:
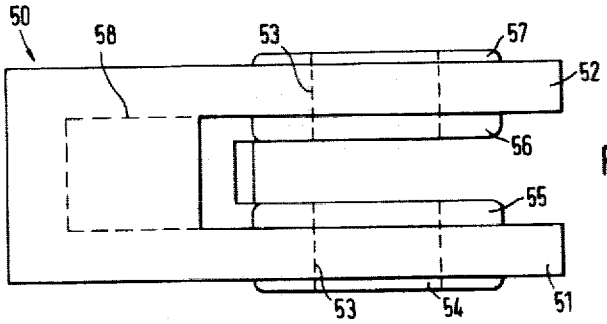
FIG. 8, is a top view of the locking lever shown in FIG. 7 viewed in the direction VIII of FIG. 7.

On journal 17 a plate type locking lever 40 is rotatably mounted. This lever 40 extends into the seat or chamber formed by the receiving slot 35 and recess 23. The locking lever 50, likewise rotatably mounted on journal 17, extends into the seat or chamber formed by the receiving slot 36 and recess 22. Lever 50 is mounted rotatably on journal 17 by means of two bearing straps 51 and 52, as the enlarged illustrations of FIGS. 7 and 8 show. The bearing straps 51 and 52 are reinforced in the region of the bearing bores 52 by ring elements 54, 55, 56 and 57. The locking lever 50 therefore is supported by the reinforcement ring 54 on the bearing shoulder 18 of the bottom portion 10 and by the reinforcement ring 57 on the semicircular portion 34 of top portion 30. The locking lever 40 is supported in the region of its bearing bore 52 on the reinforcement rings 55 and 56 of the locking lever 50 and therefore is pivotable between the two bearing straps 51 and 52.

Within locking lever 50, in the region thereof connecting the two bearing straps 51 and 52, locking lever 50 has a blind bore 58 having its opening facing the locking lever 40. The open end of bore 58 is provided with an entrance chamfer 63. Within blind bore 58 there is positioned a spring 60 formed as a helical spring, which is biased against a support surface 45 of the locking lever 40.

In the open position of the doors, therefore, spring 60 pushes the locking levers 40 and 50 against the stops 20 of the catch housing, so that they occupy the starting positions seen in FIG. 6.

The doors are provided with holding elements in the form of bolts. The bolts are oriented vertically and are introduced in such manner into the seats or chambers of the catch housing when the doors are closed.

Assuming that the lock catch is fastened to the door frame in the position shown in FIG. 6 in the region of the lower edges of the doors with upwardly open seats, the the left door must be closed first. As the door is being closed, the associated holding bolt is introduced into the seat or chamber formed by recess 22 and receiving slot 36. In so doing, the holding bolt strikes against the bevelled surface 59 of locking lever 50, which, on further introduction of the hold bolt, is pivoted counter-clockwise. After the holding bolt has advanced into the inner end region of the receiving slot 36, the locking lever 50 can reset itself by pivoting clockwise under the influence of spring 60. The locking lever 50 will then engage, by means of its bevelled surface 61, against the holding bolt, pulling the latter and the door against the door frame. If the receiving slot 36 is deep enough, it can be assured that the door will be urged against the front of the door frame snugly and under tension.

If then the right door is closed, the associated holding bolt pivots the locking lever 40 clockwise via the bevelled surface 43 against the locking lever 50, which is again firmly in its initial starting position but not yet against stop 20. After the hold bolt has reached the inner end region of the receiving slot 35, the locking lever 40 pivots back counter-clockwise under the influence of spring 60 and retains the holding bolt under spring action or bias, through its bevelled surface 44, so that the second door also is urged against the front of the door frame snugly and under tension.

Once in its closed position, the locking lever 50 protrudes by means of blocking shoulders 62 of both bearing straps 51 and 52 into the inner end region of the receiving slot 35. Once in this receiving slot 35 the holding bolt is held by the locking lever 40 and locking lever 50 can no longer be pivoted since blocking shoulders 62 then are urged against the holding bolt. The result is that the left door cannot be opened unless the last closed right door is opened first. Only then can the holding bolt be extracted form the receiving slot 36 by pivoting of locking lever 50. The bevelled surfaces 44 and 61 of the locking levers 40 and 50 are inclined at the same angle so that the locking levers 40 and 50 are mutually pivoted as the holding bolts are extracted.

As the locking levers 40 and 50 are formed symmetrically with the edian plane perpendicular to the pivot axis, they may be mounted on the journal 17 for 180 degrees rotation. The lock catch then fixed on the door frame when rotated 180 degrees in the region of the upper edges of the doors is then matched to the closing and blocking function of the just described lock catch on the lower edges of the doors, so that the left door is locked and blocked at the bottom and top. The two lock catches can be made with standard components merely by different installation.

The receiving slots 35 and 36 as well as the seats 22 and 23 may be wider than the diameter of the holding bolts, so that also relatively great tolerances in the hanging of the doors and in the application of the holding bolts on these doors can be compensated. Also the play in the locking direction can be compensated to a large extent by appropriate design of the receiving slots 35 and 36, a tractive force being always additionally exerted on the doors in the end position to hold them in abutment on the front of the door frame.

The rotatable mounting of the locking levers 40 and 50 on the end opposite the introduction end and the special design of the bevelled surfaces 43 and 59, as well as the bevelled surfaces 44 and 61, offer a new closing-opening characteristic which differs essentially from that of known lock catches. The bevelled surfaces 43 and 59 of locking levers 40 and 50 are oriented in the closing direction in an acute angle to the longitudinal median axes of the receiving slots 35 and 36 of about 30°, so that when introducing the holding bolts fastened to the doors, a large lever arm is initially present in the action on the locking levers 40 and 50. The locking levers 40 and 50 can therefore be deflected with a small force. For this the force of the return springs in the hinges of the hung door is often sufficient, so that the door brought into the closing position practically locks by itself. Since the approach path of the holding bolt into the receiving bolt is relatively long, a continuous closing and locking process is achieved. The bevelled surfaces 44 and 61 of the locking levers 40 and 50 are oriented in the opening direction in an obtuse angle to the longitudinal median axes of the receiving slots 35 and 36 of about 110°, so that when extracting or withdrawing the holding bolts fastened to the doors a small lever arm is present in the action on the locking levers 40 and 50. This lever arm is smaller than the lever arm with which the compression spring acts in the contrary direction on the locking levers 40 and 50. Therefore a force differential exists so that the doors can be opened only with a greater tractive force. In opening the doors the additional closing forces of the return springs in the hinges must be overcome.

Naturally, it is possible also to use the lock catch according to the invention as a simple/single catch for holding shut a single door. To this end the locking catch and holding bolt need only to be fastened on the door frame and on the door in the correct correlation. Preferably the holding bolt is provided with an attachment strap which offers two correspondingly offset attachment possibilities.

For this application, however, the lock catch itself can be simplified when the catch housing is provided with only one receiving slot.

In the catch housing only one locking lever is rotatably mounted, and the compression spring is supported therebetween this lever and the housing. Here the locking lever with the blind bore and the two bearing straps is used. The other locking lever is unnecessary. The housing parts remain the same except for the number of recesses in the end walls and the number of receiving slots. This can be achieved by simple inserts so that the single catch requires no new components.

We claim:

1. A lock catch for at least one door having at least one holding element thereon comprising:

a housing formed with a first and a second door-mounted holding element receiving slot therein;

a first and second locking lever pivotably mounted within said catch housing about a common pivot axis;

spring means positioned within said catch housing to normally bias said locking levers to project into a respective one of said holding element-receiving slots;

a first bevelled surface formed on each of said locking levers engageable by the associated holding element on the door upon the closing of same so as to effect pivotal movement of the locking lever in a first direction and permit entrance of the holding element into an inner end region of said slot inwardly of the locking lever;

a second bevelled surface formed on each of said locking levers engageable by the associated holding element of the door upon withdrawal of same from said inner end region of the slot to effect pivotal movement of the locking lever in a second and different direction and permit withdrawal of the holding element from said slot;

the first of said locking levers having a blocking shoulder formed thereon and normally extending into the inner end region of the slot associated with the second locking lever such that reception of the holding element into the inner end region of said second slot prevents pivotal movement of said first locking lever by engagement with said blocking shoulder;

said spring means being positioned relative to the pivot axis of the locking levers and said bevelled surfaces thereof such that the effective lever arm of the locking lever when the first bevelled surface is engaged by the holding element entering said slot is greater than the effective lever arm of the spring acting on said locking lever and the effective lever arm of the spring acting on the locking lever is greater than the effective lever arm of the locking lever when said second bevelled surface is engaged by the holding element during withdrawal of the holding element from said inner end region of the slot.

2. A lock catch according to claim 1, including a blind bore formed in said locking lever, said spring being positioned within said blind bore such that one end thereof is biased against the locking lever to normally bias same into said slot.

3. A lock catch according to claim 1, including a blind bore formed in said first locking lever, said spring being positioned within said blind bore such that one end thereof is biased against said first locking lever and the other end thereof projects from said blind bore to bias against said second locking lever.

4. A lock catch according to claim 1 or 3, including first and second stop elements projecting inwardly from said catch housing out of the path of said slots, each said stop element being adapted to limit the outward pivotal movement of a respective one of said locking levers.

5. A lock catch according to claim 1, wherein the said second bevelled surface on the locking lever defines in conjunction with its associated holding element-receiving slot said inner end region for entrapment of the holding element.

6. A lock catch according to claim 1, wherein said first and second locking levers are configured symmetrically relative to a median plane perpendicular to said common pivot axis to thereby be operable when rotated 180° thereabout.

7. A lock catch according to claim 1, wherein said first locking lever includes a pair of spaced parallel mounting members having aligned bores therein for mounting of said first locking lever for pivotal movement about said pivot axis, said second locking lever being pivotably mountable between the mounting members of said first locking lever for pivotal movement about said pivot axis.

8. A lock catch according to claim 1 in combination with a holding element for said door, wherein the width of said slots is dimensioned to be greater than the diameter of the holding elements of the door.

9. A lock catch according to claim 1, wherein said catch housing comprises separably box-type bottom and top portions, said bottom portion including an end wall having a recess therein corresponding with each said slot and in alignment therewith, said top portion including a cover plate and an end wall generally coextensive with the end wall of said bottom portion, said holding element-receiving slots being formed in said cover plate and end wall of said top portion of the catch housing.

10. A lock catch according to claim 9, including a plate-like attachment member integral with said bottom portion and extending therefrom, said attachment member having a pair of parallel edges, said edges being provided with aligned recesses therein located at a predetermined spacing therebetween to correspond with the spacing between holes formed in the mounting element for the lock catch.

11. A lock catch according to claim 1, wherein said first bevelled surfaces subtend an acute angle with the longitudinal axis of the holding element-receiving slots viewed towards said inner end region thereof and said second bevelled surfaces subtend an obtuse angle relative to said longitudinal axis viewed similarly.

12. A lock catch according to claim 11, wherein the angle subtended by said first bevelled surfaces and said longitudinal axis is approximately 30° and said first bevelled surfaces are given a slight convex curvature, the angle subtended by said second bevelled surfaces and said longitudinal axis being approximately 110°, the said first and second bevelled surfaces merging by means of a rounded transitional surface therebetween.

* * * * *